US006682867B2

(12) United States Patent
Kubo et al.

(10) Patent No.: US 6,682,867 B2
(45) Date of Patent: Jan. 27, 2004

(54) TONER FOR ELECTROPHOTOGRAPHY

(75) Inventors: Masahiko Kubo, Nara (JP); Tadayuki Sawai, Nara (JP); Satoshi Ogawa, Nara (JP); Hiroyuki Terada, Chiba (JP); Kinji Shinzo, Sakura (JP); Yoshinori Shimane, Ichikawa (JP)

(73) Assignees: Dainippon Ink & Chemicals, Inc., Tokyo (JP); Sharp Kabushiki Kaisha, Osaka (JP)

( * ) Notice: Subject to any disclaimer, the term of this patent is extended or adjusted under 35 U.S.C. 154(b) by 3 days.

(21) Appl. No.: 10/118,006

(22) Filed: Apr. 9, 2002

(65) Prior Publication Data

US 2002/0192586 A1 Dec. 19, 2002

(30) Foreign Application Priority Data

Apr. 10, 2001 (JP) ..... 2001-111828

(51) Int. Cl.[7] ..... G03G 9/087

(52) U.S. Cl. ..... 430/109.2; 430/109.4; 430/109.3; 430/111.4; 430/108.23

(58) Field of Search ..... 430/109.4, 111.4, 430/109.2, 109.3, 108.23

(56) References Cited

U.S. PATENT DOCUMENTS

| | | | | |
|---|---|---|---|---|
| 5,514,511 | A | 5/1996 | Iwamoto et al. | |
| 5,753,399 | A * | 5/1998 | Hayase et al. | 430/109.4 |
| 5,955,234 | A * | 9/1999 | Matsunaga et al. | 430/111.4 |
| 6,248,491 | B1 * | 6/2001 | Takayanagi et al. | 430/109.4 |
| 6,503,679 | B2 * | 1/2003 | Aoki et al. | 430/109.4 |

FOREIGN PATENT DOCUMENTS

| | | |
|---|---|---|
| EP | 0 516 153 | 12/1992 |
| EP | 0 836 121 | 4/1998 |
| JP | 4-012367 | 1/1992 |
| JP | 5-165252 | 7/1993 |

* cited by examiner

*Primary Examiner*—Christopher Rodee
(74) *Attorney, Agent, or Firm*—Nixon & Vanderhye P.C.

(57) ABSTRACT

A toner for electrophotography comprises: a coloring agent and a binding resin comprising a polyester resin constituted of cyclohexanedimethanol as an essential polyol component, wherein the toner has, at 110° C., a storage elastic modulus of $3\times10^4$ Pa or less and a loss elastic modulus of $6\times10^4$ Pa or less, and, at 150° C., a storage elastic modulus of 1×10 Pa or more and a loss elastic modulus of $1\times10^2$ Pa or more.

15 Claims, 1 Drawing Sheet

TONER FOR ELECTROPHOTOGRAPHY

CROSS-REFERENCE TO RELATED APPLICATION

This application is related to Japanese Patent Application No. 2001-111828 filed on Apr. 10, 2001, whose priority is claimed under 35 USC §119, the disclosure of which is incorporated by reference in its entirety.

BACKGROUND OF THE INVENTION

1. Field of the Invention

The present invention relates to a toner for electrophotography. More particularly, it relates to a toner for full-color electrophotography which is used for image-forming apparatuses using so-called electrophotographic techniques such as electrostatic copiers, laser beam printers and the like.

2. Description of Related Art

Many electrophotographic techniques have been conventionally known, which, in general, form electrical latent images on photoconductors by various means with use of photoconductive materials, develop the latent images with use of toners, transfer toner images onto recording media such as paper as the need arises, and then fix the toner images by heat, pressure or a vapor of a solvent to obtain copies.

In the electrophotography, full-color images are made by overlaying toners of three colors, i.e., yellow (Y), magenta (M) and cyan (C) or of four colors, i.e., the three colors plus black. More particularly, charging, exposure, development and transfer are repeated for every toner to form toner images of a plurality of colors of toners on a recording medium and fixing the toner images by fusing and mixing (mixing color) the toner colors.

Various techniques and apparatuses have been developed for the last step in the full-color image formation, i.e., the step of fixing toner images onto recording media such as paper.

These techniques can prevent offset effectively. However, the toners have a high elasticity since they contain a lot of crosslinked acid components and polymeric components. Accordingly, the toners do not form flat surfaces on which they are fixed in the range of relatively low temperatures, which is a problem from the viewpoint of color reproducibility as full-color toners.

Further, Japanese Unexamined Patent Publication Nos. HEI 4(1992)-12367 and HEI 5(1993)-165252 propose toners having a binding resin of a polyester containing cyclohexane dimethanol as an essential polyol component. However, these publications do not give consideration as to how to use the toners for exhibiting the characteristics of the resin better. Thus, even if toner images formed using these toners are fixed by an ordinary fixing method, sufficient color mixing is not performed. At present, is not obtained yet a toner which can provide high-quality color images with a smooth surface with wide-ranged color reproduction in an increased fixing temperature range without image deterioration due to oil.

SUMMARY OF THE INVENTION

Thus, the present invention has been made in view of the above-mentioned problems, and an object of the present invention is to provide a toner for electrophotography which has a sufficient color mixing property and transparency and which can provide high-quality color images having a flat surface and free of deterioration due to oil, with a wide color reproducibility in a wide fixing temperature range.

The present invention provides a toner for electrophotography comprising: a coloring agent and a binding resin comprising a polyester resin constituted of cyclohexanedimethanol as an essential polyol component, wherein the toner has, at 110° C., a storage elastic modulus of $3\times10^4$ Pa or less and a loss elastic modulus of $6\times10^4$ Pa or less, and, at 150° C., a storage elastic modulus of $1\times10$ Pa or more and a loss elastic modulus of $1\times10^2$ Pa or more.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
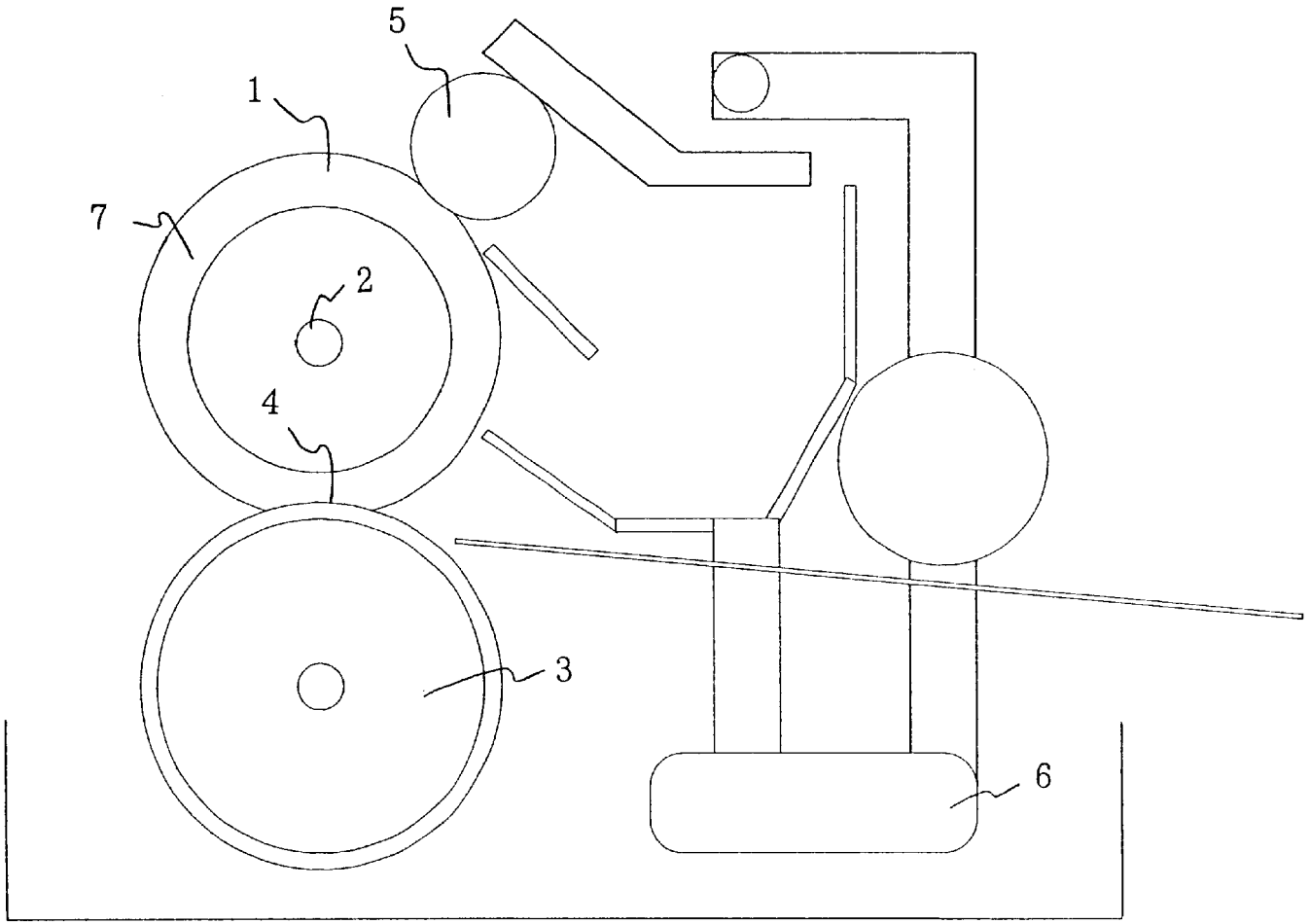
FIG. 1 is a schematic sectional view of an essential part of a typical fixing apparatus showing the construction of the apparatus.

The toner of the present invention is composed mainly of a coloring agent and a binding resin, and may be non-magnetic toner. At 110° C., the toner has a storage elastic modulus of $3\times10^4$ Pa or less and a loss elastic modulus of $6\times10^4$ Pa or less. Preferably, the toner has a storage elastic modulus of $1\times10^3$ to $3\times10^4$ Pa and a loss elastic modulus of $1\times10^3$ to $6\times10^4$ Pa. Also, at 150° C., the toner has a storage elastic modulus of $1\times10$ Pa or more and a loss elastic modulus of $1\times10^2$ Pa or more. Preferably, the toner has a storage elastic modulus of $1\times10$ to $1\times10^2$ Pa and a loss elastic modulus of $1\times10^2$ to $1\times10^3$ Pa.

If the storage elastic modulus at 110° C. is $3\times10^4$ Pa or less, a temperature range in which toner particles are completely fused and clear flat images are obtained extends particularly on its low-temperature side. If the loss elastic modulus at 110° C. is $6\times10^4$ Pa or less, a non-offset temperature range in which the toner is fused sufficiently onto a fixation sheet extends particularly on its low-temperature side. If the storage elastic modulus at 150° C. is $1\times10$ Pa or more and the loss elastic modulus at 150° C. is $1\times10^2$ Pa or more, the non-offset temperature range extends particularly on its high-temperature side.

Here, the storage elastic modulus is based on an elastic component, and the loss elastic modulus is based on a viscous component.

Methods for regulating the storage elastic modulus and the loss elastic modulus of the toner of the present invention within the above-mentioned ranges are not particularly limited. For example, may be mentioned a method of controlling the molecular weight distribution of the binding resin in the toner, a method of blending a resin and others.

For the coloring agent of the toner of the present invention, various coloring agents can be used depending upon desired color such as yellow (Y), magenta (M), cyan (C), black and the like.

As examples of coloring agents for a yellow (Y) toner, may be mentioned azo pigments classified by the color index such as C. I. pigment yellow 1, C. I. pigment yellow 5, C. I. pigment yellow 12, C. I. pigment yellow 15, C. I. pigment yellow 17, etc.; and inorganic pigments such as yellow iron oxide, yellow ochre, etc. As examples of dyes for the yellow (Y) toner, may be mentioned nitro-dyes such as C. I. acid yellow 1, etc.; and oil-soluble dyes such as C. I. solvent yellow 2, C. I. solvent yellow 6, C. I. solvent yellow 14, C. I. solvent yellow 15, C. I. solvent yellow 19, C. I. solvent yellow 21, etc. Among these, benzidine pigments such as C. I. pigment yellow 17 etc. are preferred from the viewpoint of tint for the yellow coloring agent.

As examples of coloring agents for a magenta (M) toner, may be mentioned C. I. pigment red 49, C. I. pigment red 57, C. I. pigment red 81, C. I. pigment red 122, C. I. solvent red 19, C. I. solvent red 49, C. I. solvent red 52, C. I. basic red 10, C. I. disperse red 15, etc., among which quinacridone pigments such as C. I. pigment red 122, etc. are preferred from the viewpoint of tint for the magenta coloring agent.

As examples of coloring agents for a cyan (C) toner, may be mentioned C. I. pigment blue 15, C. I. pigment blue 16, C. I. solvent blue 55, C. I. solvent blue 70, C. I. direct blue 25, C. I. direct blue 86, etc., among which copper phthalocyanine pigments such as C. I. pigment blue 15, etc. are preferred from the viewpoint of tint for the cyan coloring agent.

Carbon black may be suitably used for a black toner.

In general, a polyester resin is constituted of a polyol component and a polybasic acid component, and the toner of the present invention contains the binding resin comprised of a polyester resin constituted of cyclohexane dimethanol as an essential polyol component. Comparing the toner of the present invention with a full-color toner and a black and white toner which contain as a binding resin a polyester resin not containing cyclohexane dimethanol as the essential polyol component, the toner of the present invention has an equal fixing temperature range to that of the comparative toners out of the ranges of the viscoelastic properties of the present invention. However, the toner of the present invention has a wider fixing temperature range within the ranges of the viscoelastic properties of the present invention. The following reasons are considered to explain this improvement in the fixing temperature range: In the toner of the present invention, fine crystals of the polyester resin are dispersed in the whole binding resin. In other words, the toner includes highly viscoelastic parts generated by the dispersed fine crystals. Consequently, it is possible to greatly raise the high offset generation temperature without a decline in the color mixing property even if the elastic property represented by the storage elastic modulus is equal, while maintaining an equal fixing strength and color mixing property of a viscous component which are represented by the loss elastic modulus, as compared with the full-color toner and the black and white toner which do not contain cyclohexane dimethanol as the essential polyol component and in which fine crystals are not dispersed.

The polyester resin is preferably constituted of 5 to 60 mol % of 1,4-cyclohexanedimethanol as a polyol component. More preferably, the polyester resin may be constituted of bisphenol A alkylene oxide addition product (e.g., ethylene oxide 2 mol addition product, and propylene oxide 2 mol addition product) in addition to 1,4-cyclohexane dimethanol. Besides these polyol components, may be used diols such as ethylene glycol, triethylene glycol, 1,2-propylene glycol, 1,3-propylene glycol, 1,4-butanediol, 1,3-butanediol, 1,4-butenediol, 1,5-pentanediol, 1,6-hexanediol, hydrogenated bisphenol A, etc.; and three- or more-valent alcohols such as glycerin, trimethylol ethane, trimethylol propane, trishydroxyethylisocyanurate, pentaerythritol, etc.

As examples of a polybasic acid component constituting the polyester resin, may be mentioned dibasic acids such as succinic acid, adipic acid, sebacic acid, azelaic acid, dodecenylsuccinic acid, n-dodecylsuccinic acid, malonic acid, maleic acid, fumaric acid, citraconic acid, itaconic acid, glutaconic acid, cyclohexanedicarboxylic acid, orthophthalic acid, isophthalic acid, terephthalic acid, etc., acids with three or more bases such as trimellitic acid, trimesic acid, pyromellitic acid, etc., anhydrates and lower alkyl esters of these acids, among which terephthalic acid and lower alkyl esters thereof are preferred from the viewpoint of thermal resistance and aggregation resistance. Here, "lower alkyl" means alkyl having 1 to 5 carbon atoms.

Preferably, the polyester resin is constituted of 1,4-cyclohexanedimethanol and a bisphenol A alkylene oxide addition product as a polyol component as well as of terephthalic acid and trimellitic acid anhydride as a polybasic acid component.

For example, the polyester resin may has weight-average molecular weight of $5.0\times10^3$ to $1.0\times10^5$, prelerably $1.0\times10^4$ to $7.0\times10^4$ and number-average molecular weight of $2.0\times10^3$ to $7.0\times10^3$, prelerably $2.0\times10^3$ to $5.0\times10^3$.

The binding resin of the toner of the present invention may contain other resins than the polyester resin such as styrene acrylic resin, epoxy resin and petroleum resin which are blended therein.

The toner of the present invention may contain preferably 1 to 30 parts by weight, more preferably 2 to 20 parts by weight, of the coloring agent with respect to 100 parts by weight of the binding resin.

The toner of the present invention may contain an surface treating agent (e.g., electrostatic charge control agent) for the purpose of controlling a triboelectrostatic property of the toner. The surface treating agent may preferably be comprised of one for positive electrostatic charge control and one for negative electrostatic charge control separately according to the electrostatic charge property of the toner. As examples of the positive electrostatic charge control agent, may be mentioned organic compounds having basic nitrogen atoms such as basic dyes, quaternary ammonium salts, aminopyrin, pyrimidine compounds, polynuclear polyamino compounds, aminosilans, nigrosine base, etc. As examples of the negative electrostatic charge control agent, may be mentioned oil-soluble dyes such as oil black, etc., metal-containing azo dyes, metal naphtenates, metal salts of alkyl salicylic acids, fatty acid soap, resin acid soap and the like. The surface treating agent may preferably be contained in a proportion of 0.1 to 10 parts by weight, more preferably 0.5 to 8 parts by weight, with respect to 100 parts by weight of the binding resin. For the toner for color printing, colorless quaternary ammonium salts, metal salts of alkyl salicylic acids and the like are desirable.

Further, the toner of the present invention may contain a surface treating agent for the purpose of adjusting the flowability, the charge property and the like of the toner. As examples of the surface treating agent, may be mentioned fine powder of vinylidene fluoride, polytetrafluoroethylene, metal salts of fatty acids, zinc stearate, calcium stearate, lead stearate, zinc oxide, aluminum oxide, titanium oxide, silica or the like. The surface treating agent may preferably be contained in a proportion of 0.01 to 10 parts by weight, more preferably 0.1 to 5 parts by weight, with respect to 100 parts by weight of the resin containing the coloring agent.

The particle diameter of the toner is not particularly limited, but its average particle diameter may suitably be about 3 to 30 μm. For obtaining high-quality images, the particle diameter is preferably smaller, that is, about 9 μm or smaller, more preferably 4 to 9 μm, still more preferably 5 to 8 μm.

The toner of the present invention may be manufactured by preliminarily mixing the coloring agent, the binding resin and optionally other additives homogeneously by a dry blender, a super mixer, a ball mill or the like, melt-kneading the mixture uniformly using a kneader such as a Banbury mixer, a roll mill, a single- or double-screw extruder or the like, and then cooling, grinding and, if necessary, classifying resulting mixture.

EXAMPLES

Examples of the toner for electrophotography of the present invention is now explained in detail.

Examples 1 to 4 and Comparative Examples 1 to 9

Preparation of Toners for Yellow 100 parts by weight of a binding resin (polyester resin), 5 parts by weight of a coloring agent (C.I. pigment yellow 17) and 2.0 parts by weight of an surface treating agent (a zinc compound of salicylic acid) were mixed uniformly by a super mixer, melt-kneaded with heating by a double-screw extruder and cooled.

Table 1 shows the contents of raw materials in binding resins used in Examples 1 to 4 and Comparative Examples 1 to 5 [polyester resins (A1 to A9) composed of 1,4-cyclohexanedimethanol, bisphenol A ethylene oxide 2.2 mol addition product, terephthalic acid and/or trimellitic acid anhydride], and Table 2 shows the weight-average molecular weight and number-average molecular weight of the resins. The contents of the raw materials are all given in molar ratio. The abbreviations in the tables indicate the following: TPA terephthalic acid, TMAn: trimellitic acid anhydride, CHDM 1,4-cyclohexanedimethanol, BPAEO: bisphenol A ethylene oxide 2.2 mol addition product.

TABLE 1

| Polyester Resins | TPA | TMAn | CHDM | BPAEO |
|---|---|---|---|---|
| A1 | 100 | | 22.4 | 89.6 |
| A2 | 97 | 3 | 33.0 | 77.0 |
| A3 | 95 | 5 | 26.5 | 79.5 |
| A4 | 100 | | 48.6 | 59.4 |
| A5 | 92 | 8 | 15.3 | 86.7 |
| A6 | 100 | | 38.9 | 72.2 |
| A7 | 88 | 12 | 20.4 | 81.6 |
| A8 | 88 | 12 | 36.1 | 67.0 |
| A9 | 95 | 5 | 10.4 | 93.6 |

TABLE 2

| Polyester Resins | Weight-Average Molecular Weight (Mw) | Number-Average Molecular Weight (Mn) |
|---|---|---|
| A1 | $1.2 \times 10^4$ | $4.3 \times 10^3$ |
| A2 | $1.3 \times 10^4$ | $4.6 \times 10^3$ |
| A3 | $1.5 \times 10^4$ | $4.9 \times 10^3$ |
| A4 | $1.1 \times 10^4$ | $4.2 \times 10^3$ |
| A5 | $3.0 \times 10^4$ | $5.0 \times 10^3$ |
| A6 | $1.0 \times 10^4$ | $4.0 \times 10^3$ |
| A7 | $5.0 \times 10^4$ | $4.9 \times 10^3$ |
| A8 | $3.0 \times 10^4$ | $3.0 \times 10^3$ |
| A9 | $2.0 \times 10^4$ | $4.7 \times 10^3$ |

Table 3 shows the contents of raw materials in binding resins used in Comparative Examples 6 to 9 [polyester resins (B1 to B4) composed of bisphenol A propylene oxide 2.2 mol addition product, terephthalic acid, fumaric acid and/or trimellitic acid anhydride], and Table 2 shows the weight-average molecular weight and number-average molecular weight of the resins. The contents of the raw materials are all given in molar ratio. The abbreviations in the tables indicate the following: TPA: terephthalic acid, FA: fumaric acid, TMAn: trimellitic acid anhydride, BPAEO: bisphenol A ethylene oxide 2.2 mol addition product.

TABLE 3

| Polyester Resins | TPA | FA | TMAn | BPAEO |
|---|---|---|---|---|
| B1 | 100 | | | 112.0 |
| B2 | 97 | | 3 | 111.0 |
| B3 | 97 | 3 | | 110.0 |
| B4 | 100 | | | 108.0 |

TABLE 4

| Polyester Resins | Weight-Average Molecular Weight (Mw) | Number-Average Molecular Weight (Mn) |
|---|---|---|
| B1 | $9.2 \times 10^3$ | $3.3 \times 10^3$ |
| B2 | $1.3 \times 10^4$ | $4.5 \times 10^3$ |
| B3 | $1.4 \times 10^4$ | $4.9 \times 10^3$ |
| B4 | $1.1 \times 10^4$ | $4.1 \times 10^3$ |

The kneaded products were ground roughly by a cutting mill and then finely ground by a supersonic jet mill. Dust-size particles of 5 μm or less diameter were removed by a classifier to obtain color toners for yellow (Y). The particle diameter of the toners was distributed within the range of 5 to 16 μm, and the average particle diameter was 8.0 μm.

Preparation of Toners for Cyan

Color toners for Cyan (C) used in the examples and the comparative examples were prepared in the same manner as described above except that C.I. pigment blue 15 was used as a coloring agent.

Dynamic Viscoelsticity of Toners

Dynamic variation stress was applied to the toners for yellow and cyan obtained above, and the storage elastic modulus and the loss elastic modulus were measured using a Rheo Stress RS75 manufactured by HAAKE. The dynamic variation stress was applied by a 20 mm parallel plate with a 50% distortion at 1.0 Hz. The results are shown in Table 5.

TABLE 5

| Polyester Resins | Storage Elastic Modulus (110° C.) | Loss Elastic Modulus (110° C.) | Storage Elastic Modulus (150° C.) | Loss Elastic Modulus (150° C.) |
|---|---|---|---|---|
| A1 | $5.1 \times 10^3$ | $2.1 \times 10^4$ | $1.1 \times 10^1$ | $2.0 \times 10^2$ |
| A2 | $1.1 \times 10^4$ | $4.1 \times 10^4$ | $2.5 \times 10^1$ | $4.0 \times 10^2$ |
| A3 | $2.2 \times 10^4$ | $5.9 \times 10^3$ | $3.0 \times 10^1$ | $6.0 \times 10^2$ |
| A4 | $1.5 \times 10^4$ | $3.5 \times 10^4$ | $2.0 \times 10^1$ | $3.2 \times 10^2$ |
| A5 | $3.0 \times 10^4$ | $6.2 \times 10^4$ | $3.5 \times 10^1$ | $6.1 \times 10^2$ |
| A6 | $3.2 \times 10^4$ | $5.7 \times 10^4$ | $9.0 \times 10^0$ | $2.0 \times 10^2$ |
| A7 | $3.3 \times 10^4$ | $7.3 \times 10^4$ | $5.0 \times 10^1$ | $7.0 \times 10^2$ |
| A8 | $2.8 \times 10^4$ | $6.2 \times 10^4$ | $3.2 \times 10^1$ | $1.9 \times 10^2$ |
| A9 | $2.7 \times 10^4$ | $6.3 \times 10^4$ | $2.0 \times 10^1$ | $5.0 \times 10^2$ |
| B1 | $5.0 \times 10^3$ | $2.0 \times 10^4$ | $1.1 \times 10^1$ | $2.0 \times 10^2$ |
| B2 | $1.0 \times 10^4$ | $4.0 \times 10^4$ | $2.4 \times 10^1$ | $4.0 \times 10^2$ |

TABLE 5-continued

| Polyester Resins | Storage Elastic Modulus (110° C.) | Loss Elastic Modulus (110° C.) | Storage Elastic Modulus (150° C.) | Loss Elastic Modulus (150° C.) |
|---|---|---|---|---|
| B3 | $2.3 \times 10^4$ | $5.9 \times 10^3$ | $3.1 \times 10^1$ | $6.0 \times 10^2$ |
| B4 | $1.5 \times 10^4$ | $3.4 \times 10^4$ | $2.0 \times 10^1$ | $3.2 \times 10^2$ |

Printing Test I

The produced color toners for yellow (Y) and Cyan (C) were mixed with a carrier to give developers for each color. As the carrier, ferrite particles were used. The concentration of the toners in the developers was set to 4.0 wt %.

Subsequently, by use of an electrophotographic color printer equipped with an OPC photoconductive drum using a typical heat-fusing roller fixing device G which includes a fusing roller 1, a heater lamp 2, a pressure roller 3, an oil application roller 5 and an oil tank 6 and has a recess 4 in a rubber layer 7 of the fixing roller 1, color images were formed with the toners for yellow (Y) and cyan (C) on a recording medium (paper) at a speed of 120 mm/second with varying the temperature of the fusing roller from 100 to 210° C. by 10° C.

The resulting color images were irradiated with light of 540 nm wavelength to measure their spectral reflection characteristics, which were compared with the reflectance in single-colored images produced only with the developers for cyan (C) to obtain ratio (%) of decrease in the reflectance. A temperature range in which the decrease ratio did not exceed 5% was defined. The results are shown in Table 6.

Printing Test II

Single- to three-layered images were produced by performing transfer once to three times using the color toners for cyan (C) in the same manner as described above, to obtain a non-offset temperature range. The results are shown in Table 6.

TABLE 6

| | Binding Resin | Color Mixing Temperature Range (° C.) | Non-Offset Temperature Range (° C.) | Evaluation |
|---|---|---|---|---|
| Example 1 | A1 | 130 or more | 120~180 | ○ |
| Example 2 | A2 | 140 or more | 130~190 | ○ |
| Example 3 | A3 | 150 or more | 140~200 | ○ |
| Example 4 | A4 | 130 or more | 120~180 | ○ |
| Com. Ex. 1 | A5 | 170 or more | 140~200 | X |
| Com. Ex. 2 | A6 | 130 or more | 120~160 | X |
| Com. Ex. 3 | A7 | 180 or more | 150~200 | X |
| Com. Ex. 4 | A8 | 150 or more | 140~180 | X |
| Com. Ex. 5 | A9 | 170 or more | 150~190 | X |
| Com. Ex. 6 | B1 | 130 or more | 120~160 | X |
| Com. Ex. 7 | B2 | 140 or more | 130~170 | X |
| Com. Ex. 8 | B3 | 150 or more | 140~180 | X |
| Com. Ex. 9 | B4 | 130 or more | 120~160 | X |

Evaluation: ○ Both color mixing and non-offset are satisfied within a temperature range extending 50° C. or more.

Table 6 shows that Examples 1 to 4 brought about good results in a color-mixing temperature range (color developing properties) and in a non-offset temperature range, but that Comparative Examples 1 to 5 did not bring about good results since Comparative Examples 1 to 5 used the toners whose dynamic viscoelastic properties were outside the dynamic viscoelasticity range of the present invention. Comparative Examples 6 to 9 did not bring about good results since Comparative Examples 6 to 9 used the binding resins whose composition was not that of the present invention.

According to the toner of the present invention, fine crystals of the polyester resin are dispersed in the whole binding resin. In other words, the toner includes highly viscoelastic parts generated by the dispersed fine crystals. Consequently, it is possible to greatly raise the high offset generation temperature without a decline in the color mixing property even if the elastic property represented by the storage elastic modulus is equal, while maintaining an equal fixing strength and color mixing property of a viscous component which are represented by the loss elastic modulus. Also, it is possible to provide high-quality color images and improve the melting state of the toner and to provide images with good color developing characteristics in an increased non-offset range.

Further, in the case where a polyester resin containing cyclohexane dimethanol as an essential polyalcohol ingredient is used as a binding resin of the toner, it is possible to improve the thermal resistance and aggregation resistance of the toner and to produce full-color images with higher quality.

What is claimed is:

1. A non-magnetic toner for electrophotography comprising:

a coloring agent, and a binding resin comprising a polyester resin comprising cyclohexanedimethanol as a polyol component, wherein the toner has, at 110° C., a storage elastic modulus of $3\times10^4$ Pa or less and a loss elastic modulus of $6\times10^4$ Pa or less, and, at 150°C., a storage elastic modulus of 1×10 Pa or more and a loss elastic modulus of $1\times10^2$ Pa or more.

2. The non-magnetic toner according to claim 1, wherein the polyester resin is constituted of a bisphenol A alkylene oxide addition product as a polyol component in addition to cyclohexanedimethanol.

3. The non-magnetic toner according to claim 1, wherein the polyester resin is constituted of at least one polyol component selected from the group consisting of ethylene glycol, triethylene glycol, 1,2-propylene glycol, 1,3-propylene glycol, 1,4-butanediol, 1,3-butanediol, 1,4-butenediol, 1,5-pentanediol, 1,6-hexanediol, hydrogenated bisphenol A, glycerin, trimethylol ethane, trimethylol propane, trishydroxyethylisocyanurate and pentaerythritol in addition to cyclohexanedimethanol.

4. The non-magnetic toner according to claim 1, wherein the polyester resin is constituted of the polyol component and a polybasic acid component, the polybasic acid component is selected from the group consisting of succinic acid, adipic acid, sebacic acid, azelaic acid, dodecenylsuccinic acid, n-dodecylsuccinic acid, malonic acid, maleic acid, fumaric acid, citraconic acid, itaconic acid, glutaconic acid, cyclohexanedicarboxylic acid, orthophthalic acid, isophthalic acid, terephthalic acid, trimellitic acid, trimesic acid, pyromellitic acid, anhydrates and lower alkyl esters of these acids.

5. The non-magnetic toner according to claim 1, wherein the polyester resin is constituted of 1,4-cyclohexanedimethanol and a bisphenol A alkylene oxide addition product as a polyol component, and of terephthalic acid and trimellitic acid anhydride as a polybasic acid component.

6. The non-magnetic toner according to claim 1, wherein the polyester resin has a weight-average molecular weight and a number-average molecular weight of $1.0\times10^4$ to $5.0\times10^4$ and $3.0\times10^3$ to $5.0\times10^3$, respectively.

7. The non-magnetic toner according to claim 1, wherein the binding resin of the toner further comprises a styrene acrylic resin, an epoxy resin or a petroleum resin.

8. The non-magnetic toner according to claim 1, wherein the toner contains 1 to 30 parts by weight of the coloring agent with respect to 100 parts by weight of the binding resin.

9. The non-magnetic toner according to claim 1, wherein the toner further contains an electrostatic charge control agent or a surface treating agent.

10. The non-magnetic toner according to claim 9, wherein the electrostatic charge control agent is selected from the group consisting of organic compounds having basic nitrogen atoms, oil-soluble dyes, metal-containing azo dyes, metal naphtenates, metal salts of alkyl salicylic acids, fatty acid soap and resin acid soap.

11. The non-magnetic toner according to claim 9, wherein the electrostatic charge control agent is contained in a proportion of 0.1 to 10 parts by weight with respect to 100 parts by weight of the binding resin.

12. The non-magnetic toner according to claim 9, wherein the surface treating agent is one or more fine powders selected from the group consisting of vinylidene fluoride, polytetrafluoroethylene, metal salts of fatty acids, zinc stearate, calcium stearate, lead stearate, zinc oxide, aluminum oxide, titanium oxide and of silica.

13. The non-magnetic toner according to claim 9, wherein the surface treating agent is contained in a proportion of 0.01 to 10 parts by weight with respect to 100 parts by weight of the resin containing the coloring agent.

14. The non-magnetic toner according to claim 1, wherein the toner has an average particle diameter of 3 to 30 $\mu$m.

15. The non-magnetic according to claim 1, wherein the toner is black, yellow (Y), magenta (M) or cyan (C).

* * * * *